US011647823B2

(12) United States Patent
Ishida et al.

(10) Patent No.: US 11,647,823 B2
(45) Date of Patent: May 16, 2023

(54) COSMETIC MATERIAL FEEDING CONTAINER

(71) Applicant: TOKIWA CORPORATION, Gifu (JP)

(72) Inventors: Yukikazu Ishida, Kawaguchi (JP); Hironari Kobayashi, Kawaguchi (JP)

(73) Assignee: TOKIWA CORPORATION, Gifu (JP)

( * ) Notice: Subject to any disclaimer, the term of this patent is extended or adjusted under 35 U.S.C. 154(b) by 100 days.

(21) Appl. No.: 17/504,093

(22) Filed: Oct. 18, 2021

(65) Prior Publication Data

US 2022/0117377 A1 Apr. 21, 2022

(30) Foreign Application Priority Data

Oct. 19, 2020 (JP) ..... JP2020-175339

(51) Int. Cl.
*A45D 40/20* (2006.01)

(52) U.S. Cl.
CPC ..... *A45D 40/205* (2013.01); *A45D 2040/208* (2013.01)

(58) Field of Classification Search
CPC ..... A45D 40/205; A45D 2040/208; A45D 40/20; A45D 40/00; A45D 40/04; A45D 40/02; A45D 40/06; B65D 83/0005; B65D 83/0011
USPC ..... 401/75, 80, 88, 171–174
See application file for complete search history.

(56) References Cited

U.S. PATENT DOCUMENTS

| | | | | |
|---|---|---|---|---|
| 7,736,079 | B2 * | 6/2010 | Tani | B43K 24/06 401/75 |
| 11,369,181 | B2 * | 6/2022 | Kuga | A45D 40/065 |
| 2002/0168213 | A1 | 11/2002 | Yamamoto | |
| 2022/0265027 | A1 * | 8/2022 | Sasaki | A45D 40/205 |

FOREIGN PATENT DOCUMENTS

JP 2002-336042 A 11/2002

* cited by examiner

*Primary Examiner* — David J Walczak
(74) *Attorney, Agent, or Firm* — Procopio, Cory, Hargreaves & Savitch LLP

(57) ABSTRACT

A cosmetic material feeding container includes a sleeve that is configured to accommodate a cosmetic material, a barrel that is engaged with the sleeve, a moving body that is accommodated in the sleeve and has a male screw on an outer periphery of the moving body, a screw in which a female screw to be screwed with the male screw is formed on an inner periphery of the screw, and a tail plug that is engaged with the barrel, relatively rotatable with the barrel, and is engaged with the screw. An enlarged diameter portion of the moving body is configured to contact with a spring portion of the screw from an inner side when the enlarged diameter portion comes to a position at which inward bending of the spring portion in a radial direction is restricted.

5 Claims, 21 Drawing Sheets

COSMETIC MATERIAL FEEDING CONTAINER

CROSS-REFERENCE TO RELATED APPLICATION

This application claims priority from Japanese Patent Application No. 2020-175339 filed on Oct. 19, 2020, the content of which is incorporated herein by reference in its entirety.

BACKGROUND

The present disclosure relates to a cosmetic material feeding container.

In a related art, there have been various types of cosmetic material feeding containers in which, after a moving body gripping a cosmetic material at a front end thereof reaches a feeding limit by relative rotation of a container front portion and a container rear portion, when the container front portion and the container rear portion are further relatively rotated in the same direction, a clutch mechanism is operated to prevent breakage of the moving body.

In a rod-shaped cosmetic material container described in JP-A-2002-336042, a front tube as a container front portion and a base tube as a container rear portion are engaged with each other so as to be rotatable relative to each other, and a push rod as a moving body is accommodated in the front tube and the base tube. A holding portion that constitutes a front end portion of the push rod and holds the rod-shaped cosmetic material is engaged with the front tube so as to be synchronously rotatable, and a male screw is formed along an axial direction in a portion of the push rod on a rear side of the holding portion. A helical tube having a female screw to be screwed to the male screw on an inner peripheral surface thereof is inserted into the base tube, and the base tube and the helical tube can be synchronously rotated by sliding resistance of an O-ring as a synchronous rotation unit disposed between the base tube and the helical tube.

Then, when the base tube and the front tube are relatively rotated in a feeding-out direction of the push rod, a screwing action of the male screw of the push rod and the female screw of the spiral tube works, and the push rod is fed out to reach a raising limit (a feeding limit), and when the base tube and the front tube are relatively rotated in the same direction, a torque which is a rotational force for rotating the spiral tube with respect to the base tube is applied through the push rod that is synchronously rotated with the front tube, and when the rotational torque exceeds the sliding resistance of the O-ring that synchronously rotates the base tube and the spiral tube, the spiral tube is rotated with respect to the base tube, and the push rod is protected.

However, in JP-A-2002-336042, when the push rod reaches the feeding limit, the base tube and the front tube are further rotated relative to each other in the feeding-out direction of the push rod, and the spiral tube is rotated with respect to the base tube. Since a corresponding rotational torque acts on the push rod, it is necessary to increase a diameter of the push rod to some extent to have strength. Depending on variations of the container, the diameter of the push rod may have to be reduced, and in this case, the push rod may be damaged by the rotational torque.

Therefore, an object of the present disclosure is to provide a cosmetic material feeding container capable of protecting a moving body including a push rod on which no rotational torque acts when the moving body reaches a feeding limit and further rotates the container in a feeding-out direction in which the moving body is further fed out.

SUMMARY OF INVENTION

A cosmetic material feeding container includes a sleeve that is configured to accommodate a cosmetic material and has an opening at a front end of the sleeve through which the cosmetic material is movable, a barrel that is engaged with the sleeve and synchronously rotatable with the sleeve, and has a first click tooth on an inner periphery of the barrel, a moving body that is accommodated in the sleeve, synchronously rotatable with the sleeve, has a male screw formed on an outer periphery of the moving body, and is elongated in an axial direction of the moving body, a screw that is rotatable relative to the barrel, in which a female screw to be screwed with the male screw is formed on an inner periphery of the screw, which is provided with a spring portion having flexibility in a radial direction of the screw, and in which a second click tooth is formed on an outer periphery of the spring portion, the second click tooth repeating click engagement and click release in a rotation direction relative to the first click tooth due to flexibility of the spring portion when the screw is rotated relative to the barrel, and a tail plug that is engaged with the barrel, relatively rotatable with the barrel, and is engaged with the screw and synchronously rotatable with the screw. In the cosmetic material feeding container, the relative rotation of the barrel and the tail plug causes a screwing action of the male screw and the female screw, the moving body is fed out by the screwing action and the cosmetic material appears from the opening, wherein the moving body includes an enlarged diameter portion whose diameter is enlarged in a radial direction of the moving body, and wherein the enlarged diameter portion is configured to contact with the spring portion from an inner side of the spring portion when the enlarged diameter portion comes to a position at which inward bending of the spring portion in a radial direction of the spring portion is restricted.

According to the cosmetic material feeding container, when the barrel and the tail plug are relatively rotated in the feeding-out direction of the moving body, the moving body accommodated in the sleeve is fed out and the cosmetic material is fed out by the screwing action of the male screw on an outer periphery of the moving body that synchronously rotates with the barrel and the sleeve and the female screw on an inner periphery of the screw that synchronously rotates with the tail plug. At the time of feeding out the cosmetic material by the relative rotation of the barrel and the tail plug, the first click tooth that is provided on the inner periphery of the barrel and the second click tooth that are provided on the outer periphery of the spring portion provided on the screw that synchronously rotates with the tail plug and having flexibility in the radial direction repeat the click engagement/release, and a click feeling is given to a user. The enlarged diameter portion of the moving body reaches a position on a radially inner side of the spring portion having the second click tooth of the screw and comes into contact with the spring portion, so that the spring portion is restricted from being bent to the radially inner side, and the barrel and the tail plug are prevented from further rotating relative to each other in the same direction. That is, barrel and the tail plug cannot further rotate relative to each other in the feeding-out direction in which the moving body is fed out. As a result, the enlarged diameter portion reaches the feeding limit, no rotational torque acts on the moving body, and the moving body is be protected.

In a case where the enlarged diameter portion is formed at a rear end portion of the moving body, a moving length of the moving body may be increased, and a storage amount of the cosmetic material can be increased.

Further, it is preferable that the first click tooth and the second click tooth are ratchet teeth that restrict relative rotation in a direction in which the moving body is fed back and allow relative rotation in the direction in which the moving body is fed out. In particular, the present disclosure is applied to a cosmetic material feeding container including an eyeliner using a rod-shaped cosmetic material having a thin core diameter.

As described above, according to the present disclosure, even if the container is further relatively rotated in the feeding-out direction in which the cosmetic material is fed out, the relative rotation is prevented, the rotational torque does not act on the moving body, and the moving body is protected.

DESCRIPTION OF EMBODIMENTS

Figure 1:
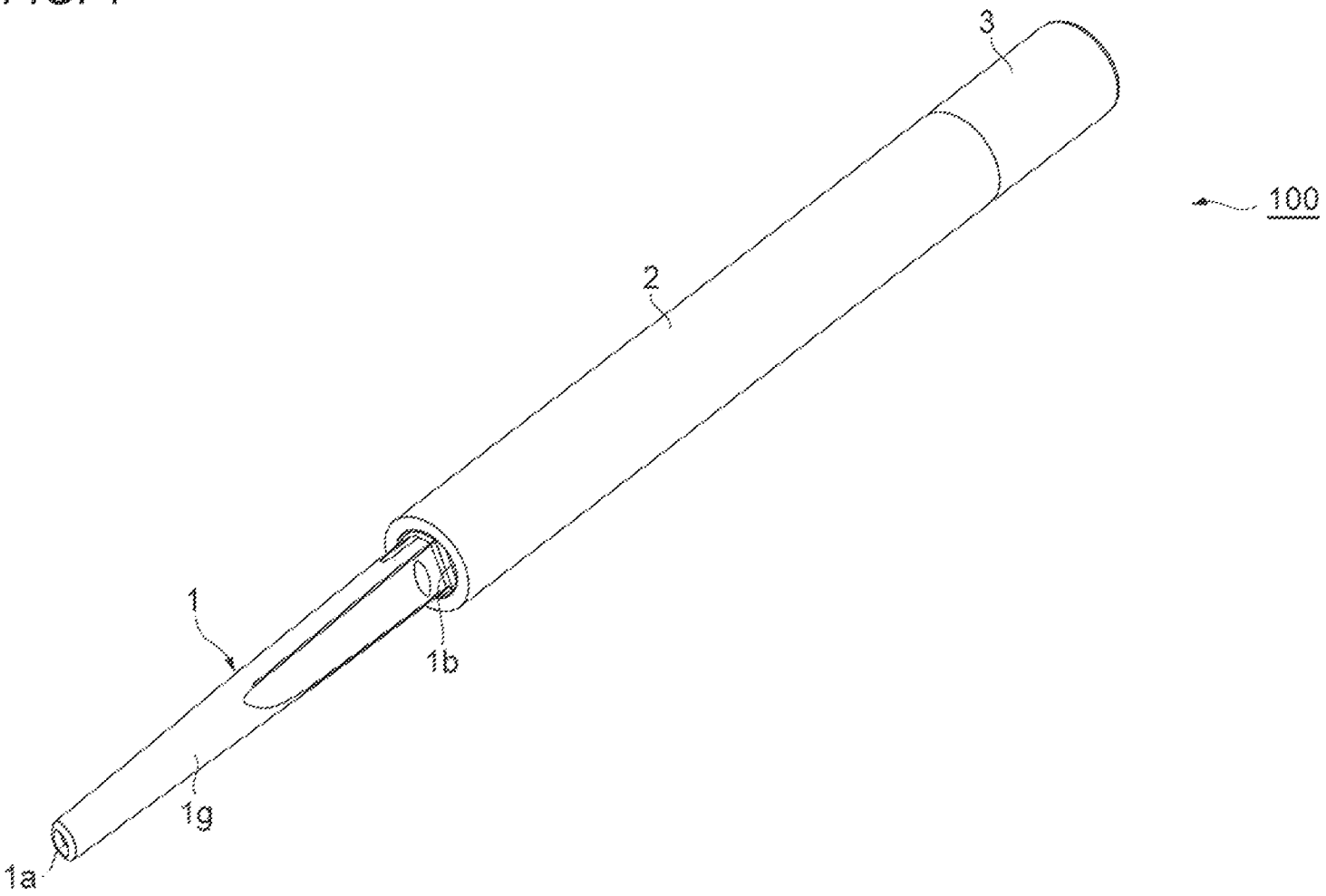
FIG. 1 is a perspective view illustrating a cosmetic material feeding container according to an embodiment of the present disclosure.
Figure 2:
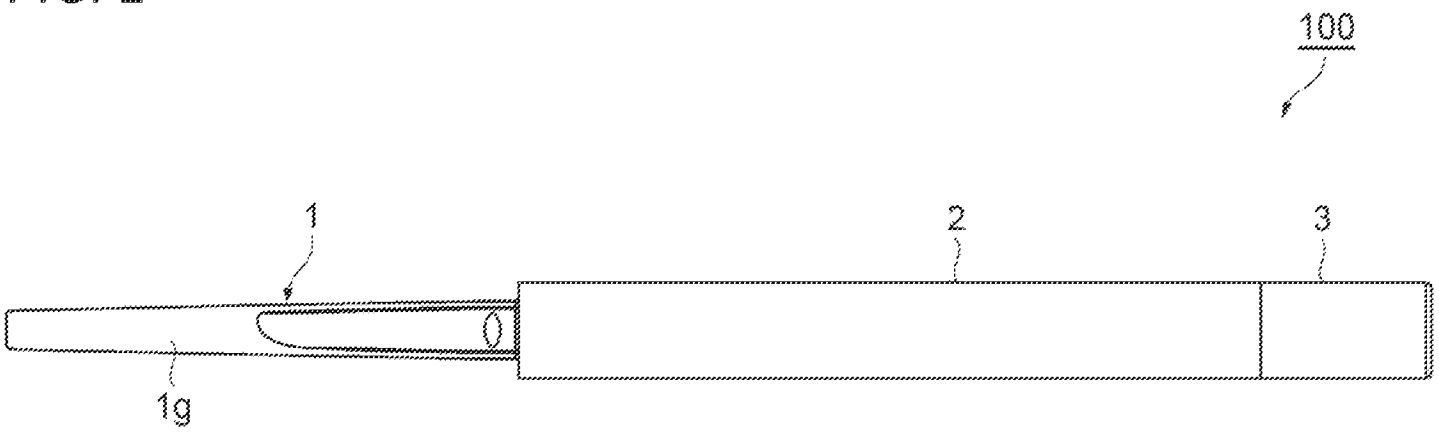
FIG. 2 is a side view of the cosmetic material feeding container illustrated in FIG. 1.
Figure 3:
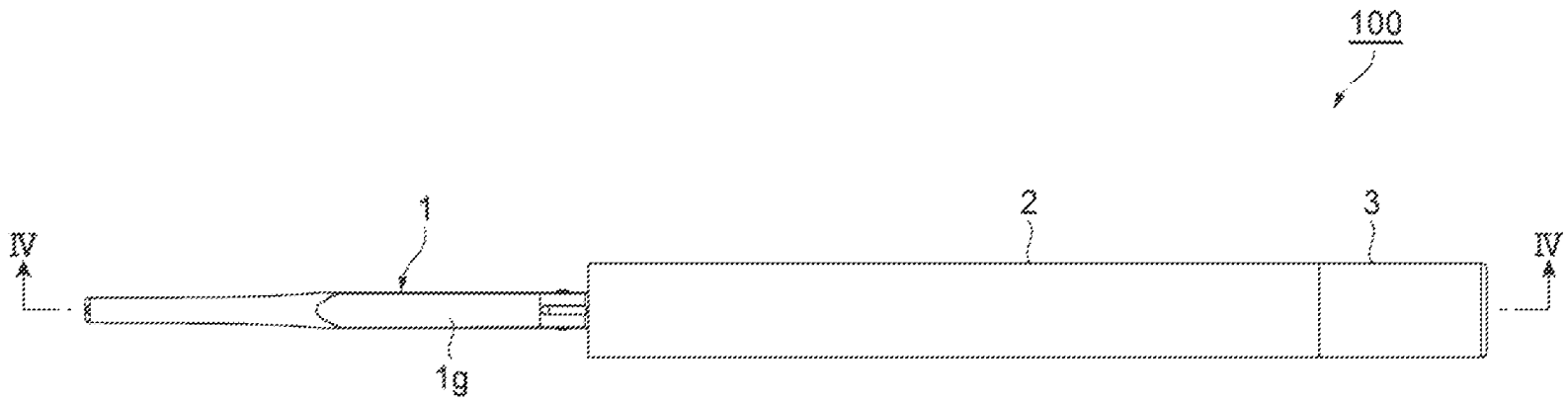
FIG. 3 is a plan view of the cosmetic material feeding container illustrated in FIG. 1.
Figure 5:
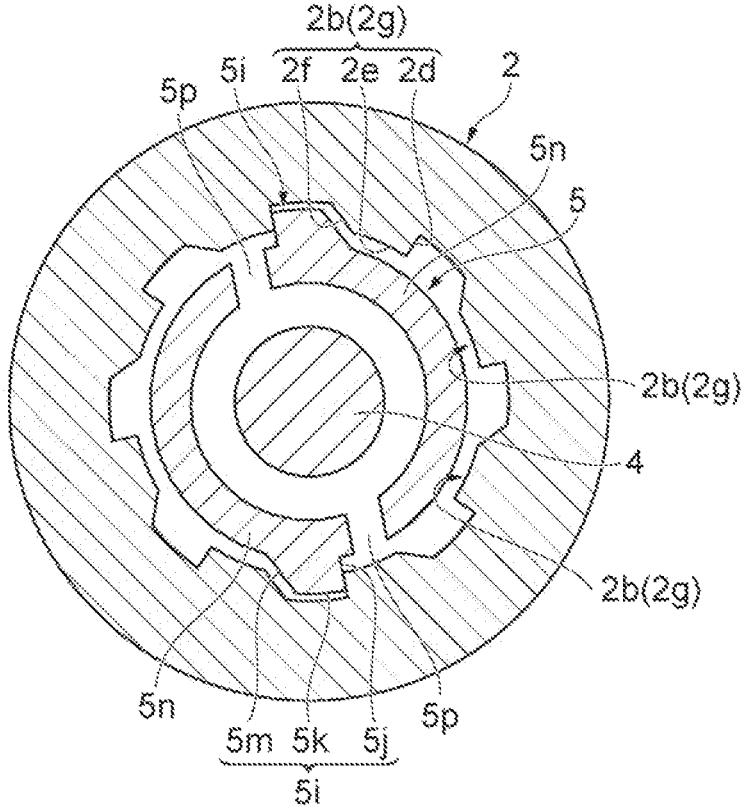
FIG. 5 is a cross-sectional view taken along a line V-V in FIG. 4.
Figure 6:
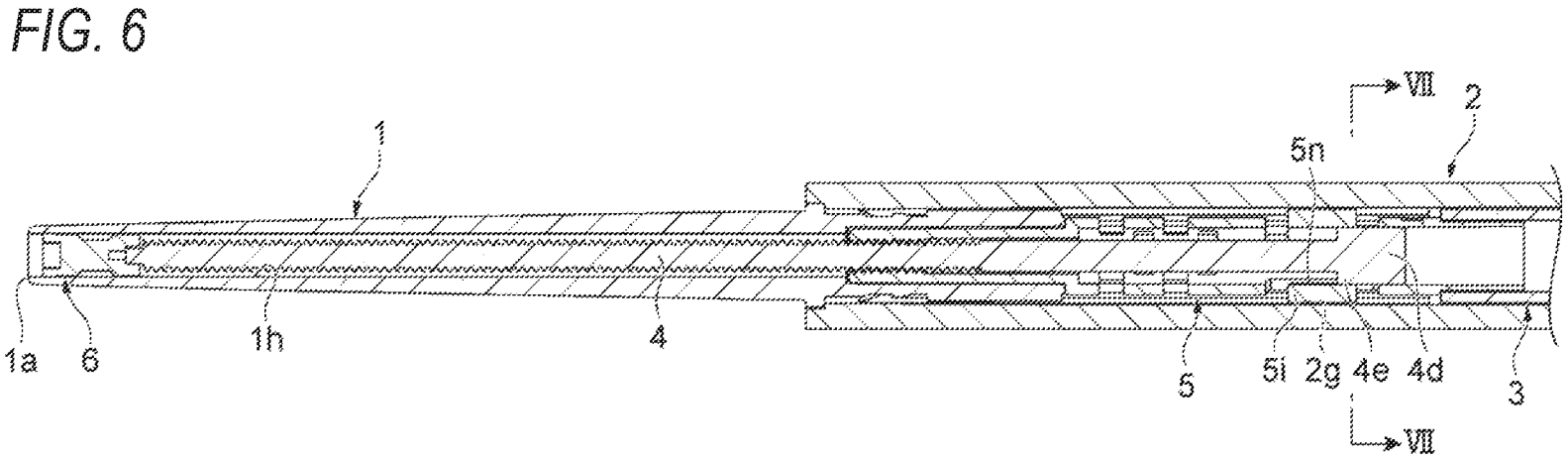
FIG. 6 is an enlarged cross-sectional view illustrating a main part of the cosmetic material feeding container, and is an enlarged view in which a rear side of a screw is omitted.
Figure 7:
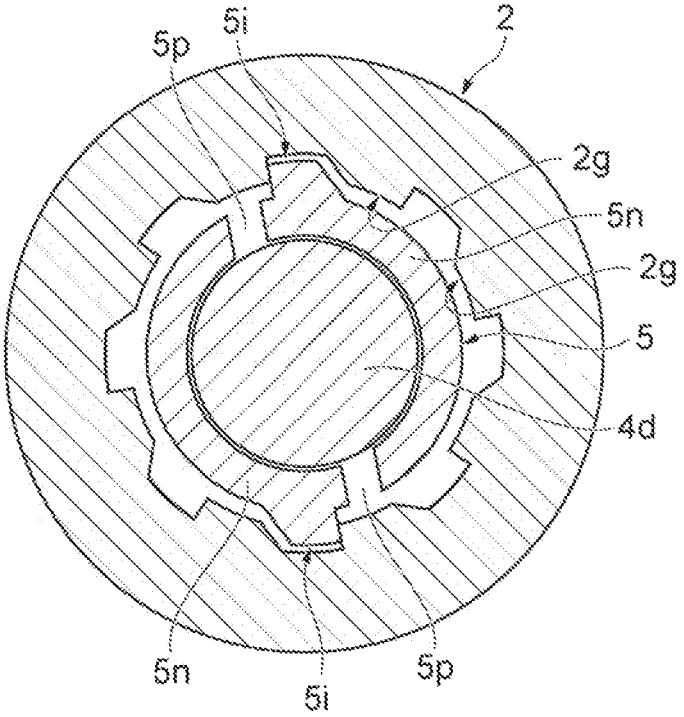
FIG. 7 is a cross-sectional view taken along a line VII-VII in FIG. 6.
Figure 8:
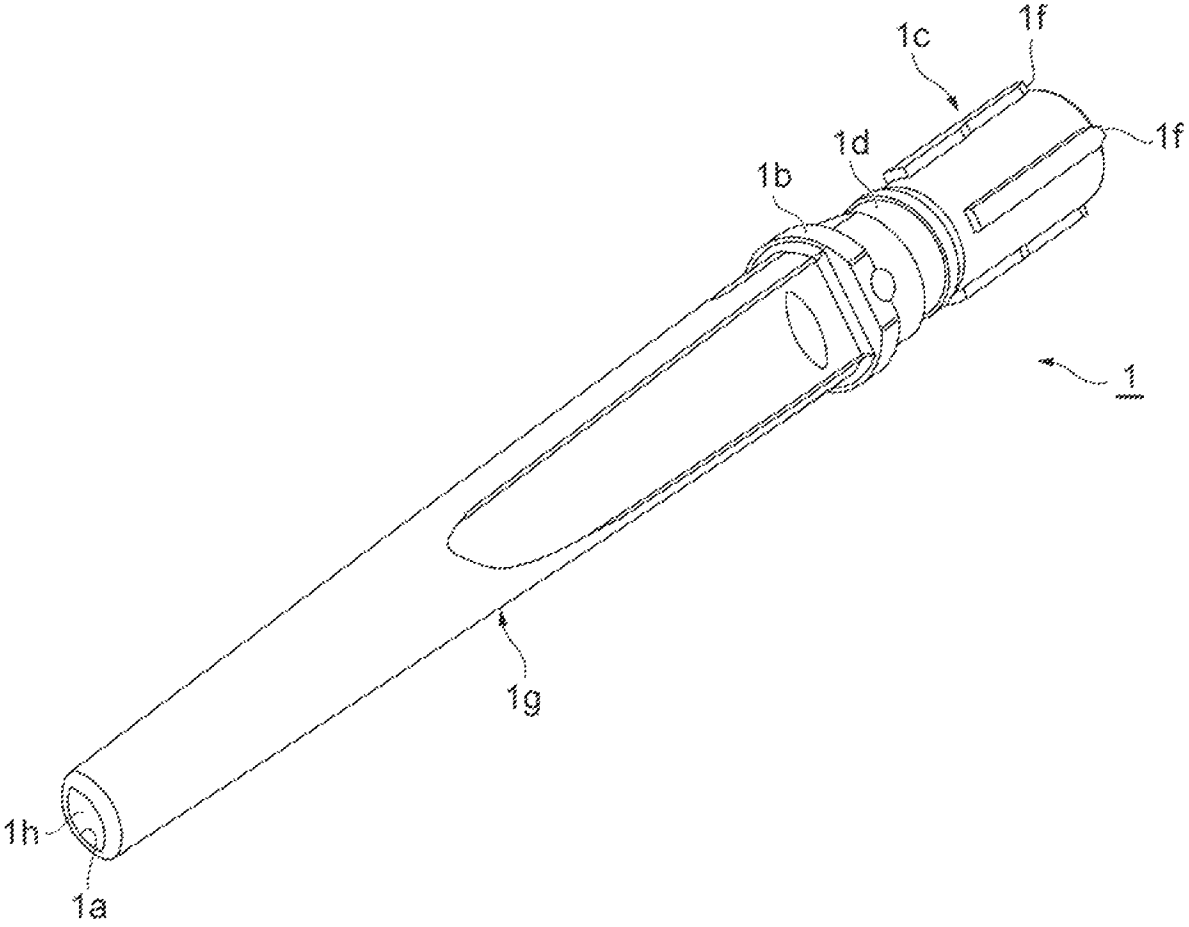
FIG. 8 is a perspective view illustrating a sleeve in FIGS. 1 to 4.
Figure 9:
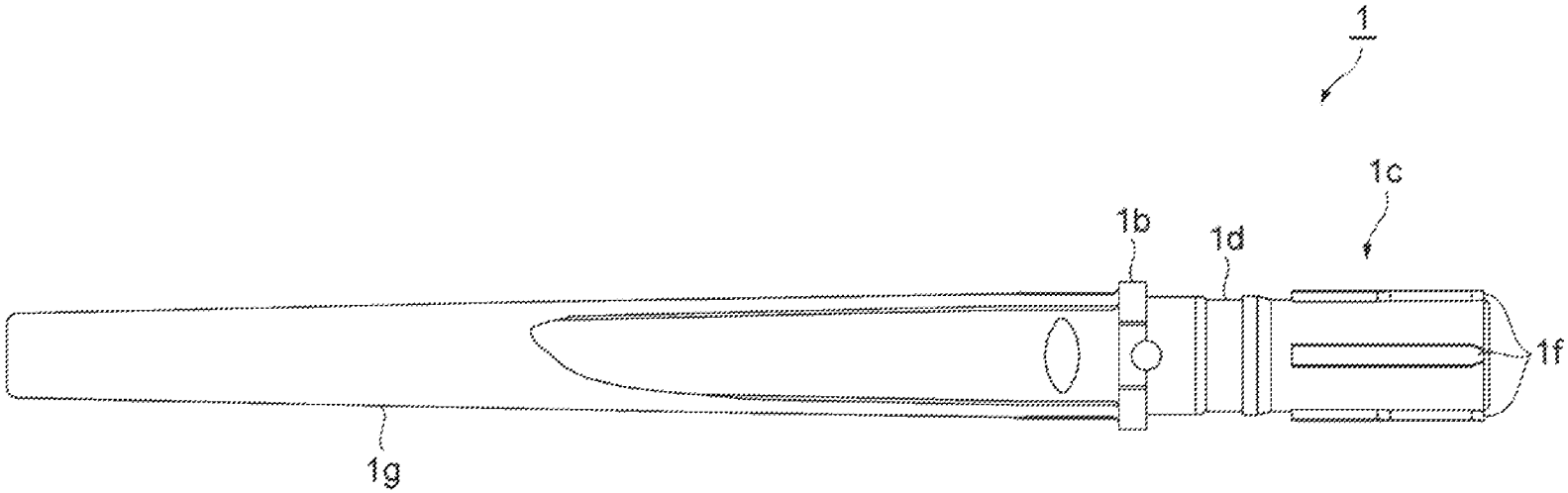
FIG. 9 is a side view of the sleeve illustrated in FIG. 8.
Figure 10:
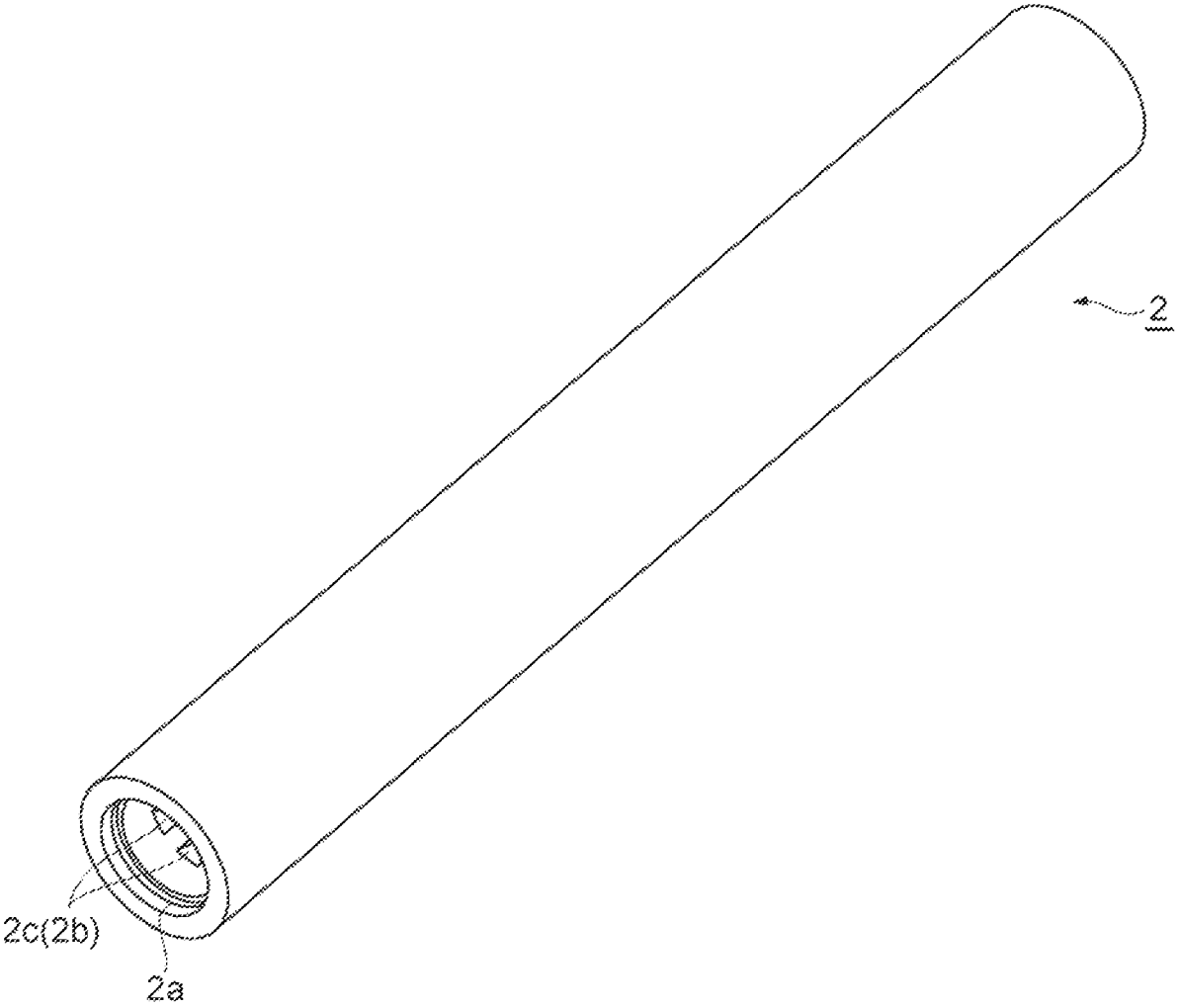
FIG. 10 is a perspective view illustrating a barrel in FIGS. 1 to 7.
Figure 11:
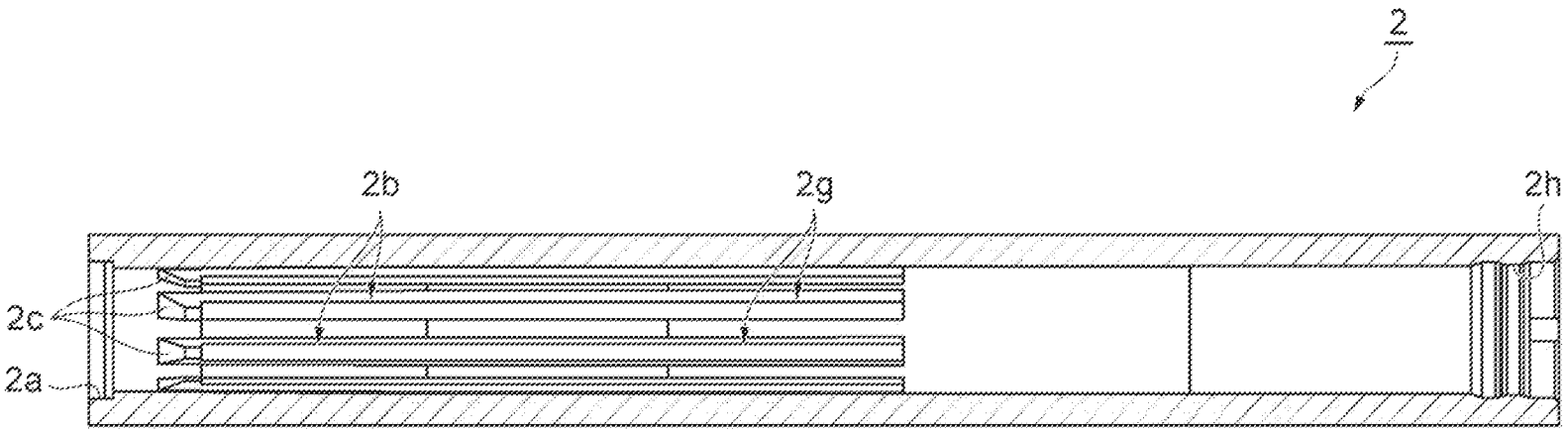
FIG. 11 is a cross-sectional view of the barrel illustrated in FIG. 10.
Figure 12:
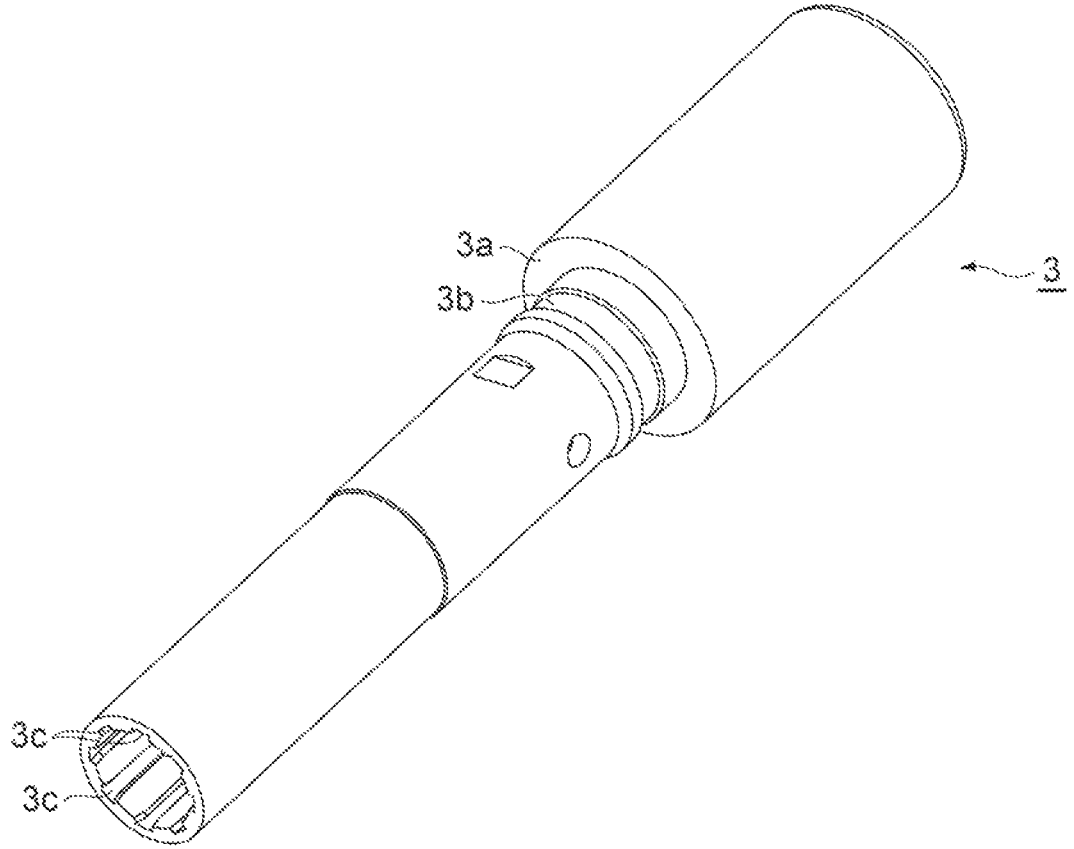
FIG. 12 is a perspective view illustrating a tail plug in FIGS. 1 to 4.
Figure 13:
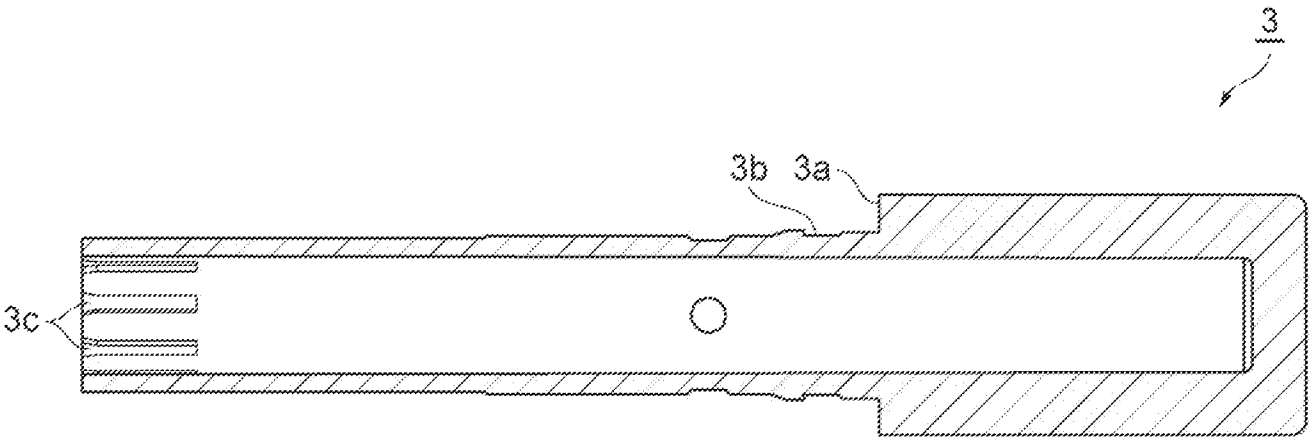
FIG. 13 is a cross-sectional view of the tail plug illustrated in FIG. 12.
Figure 18:
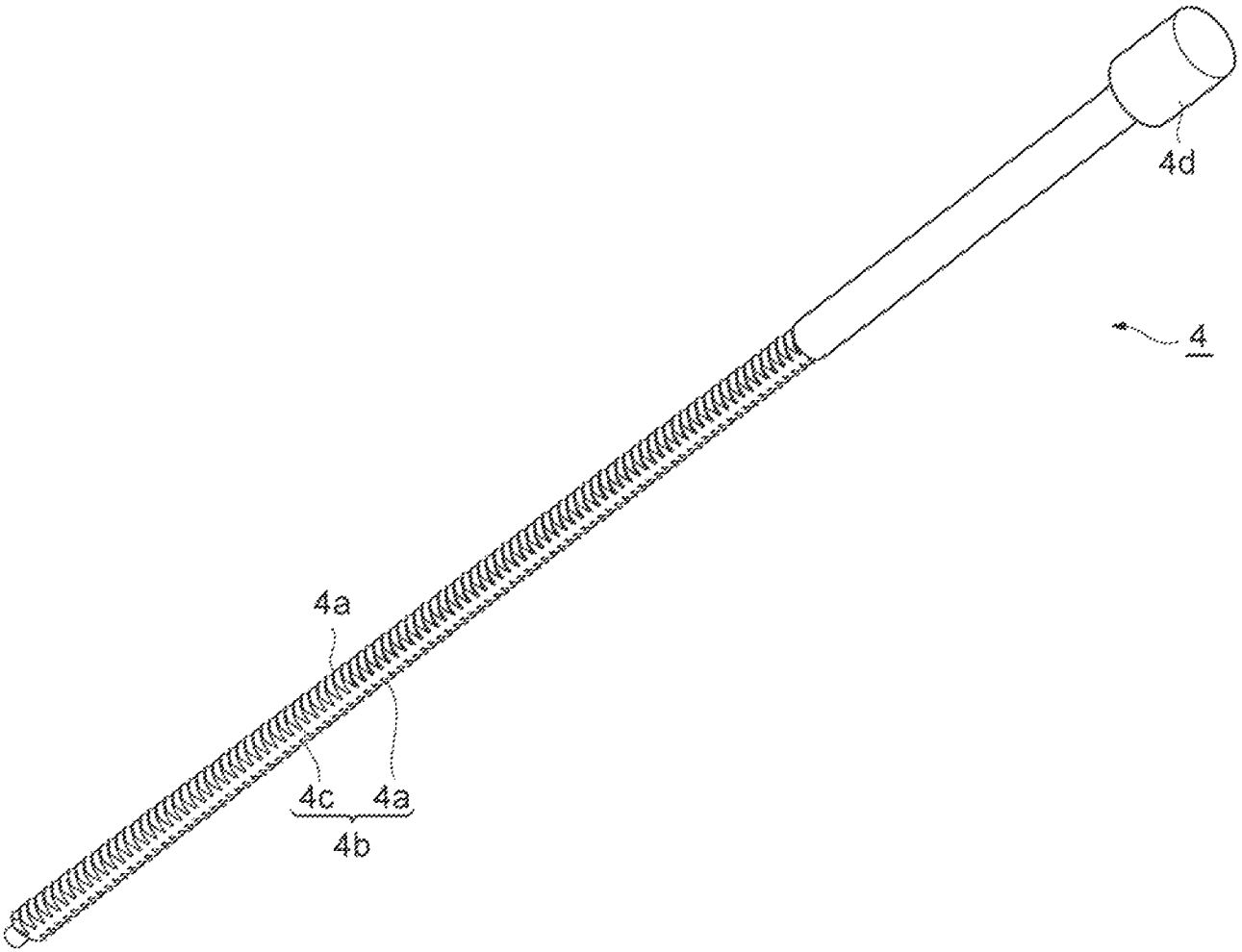
FIG. 18 is a perspective view illustrating the moving body in FIGS. 4 to 7.
Figure 19:
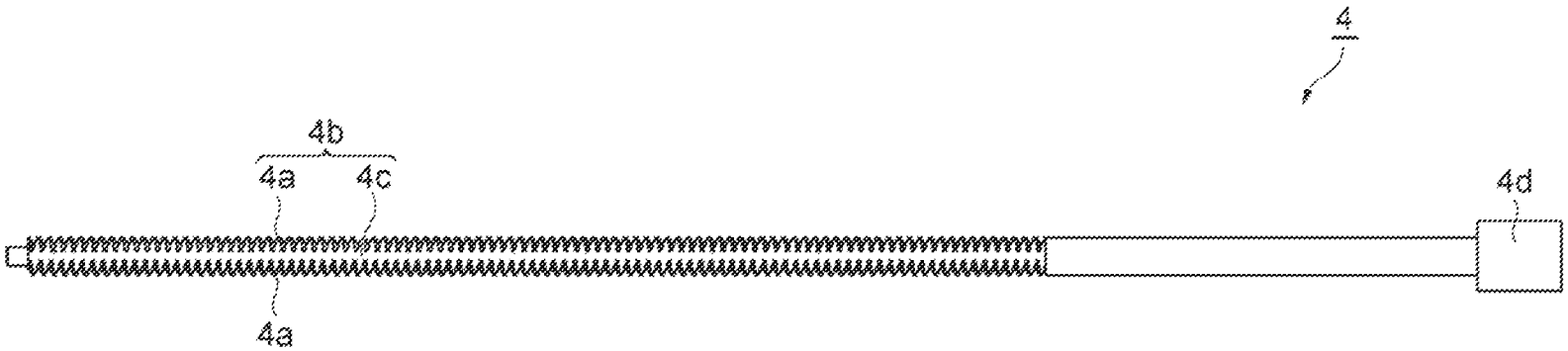
FIG. 19 is a side view of the moving body illustrated in FIG. 18.
Figure 20:
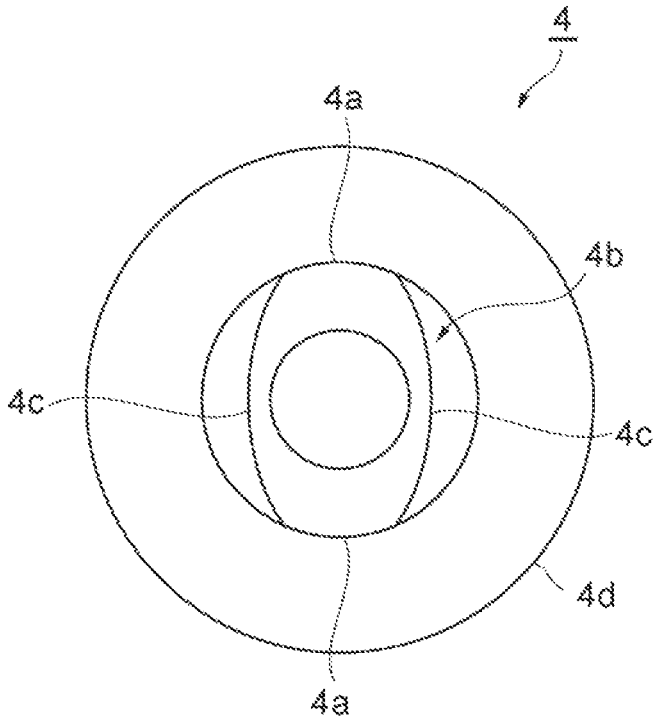
FIG. 20 is a front view of the moving body illustrated in FIG. 18.
Figure 21:
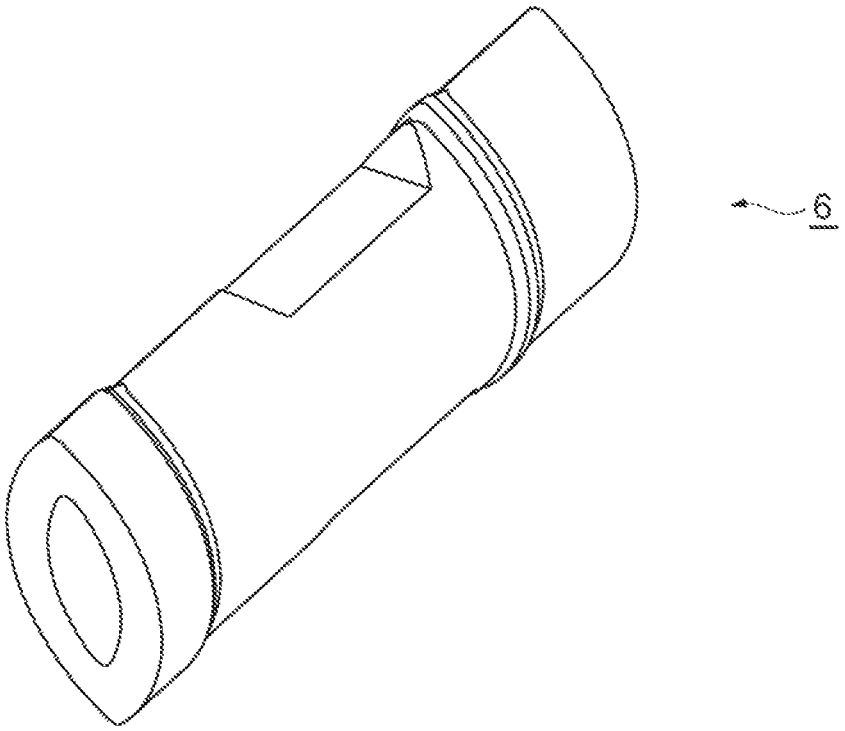
FIG. 21 is a perspective view illustrating a piston in FIGS. 4 and 6.

Hereinafter, a preferred embodiment of the cosmetic material feeding container according to the present disclosure will be described with reference to FIGS. 1 to 21. FIGS. 1 to 3 are external views illustrating the cosmetic material feeding container according to the embodiment of the present disclosure, FIG. 4 is a cross-sectional view taken along a line IV-IV in FIG. 3 and illustrating an initial state in which a moving body is located at a retreating limit, FIG. 5 is a cross-sectional view taken along a line V-V in FIG. 4, FIG. 6 is an enlarged cross-sectional view illustrating a main part of the cosmetic material feeding container, FIG. 7 is a cross-sectional view taken along a line VII-VII in FIG. 6, FIGS. 8 and 9 are views illustrating a sleeve, FIGS. 10 and 11 are views illustrating a barrel, FIGS. 12 and 13 are views illustrating a tail plug, FIGS. 14 to 17 are views illustrating a screw, FIGS. 18 to 20 are views illustrating the moving body, and FIG. 21 is a perspective view illustrating a piston.

The cosmetic material feeding container of the present embodiment contains various rod-shaped cosmetic materials including an eyeliner, an eye blow, a lip liner, a concealer, is used by a user to feed out an appropriate amount as necessary so as to make the rod-shaped cosmetic material appear for application, and is particularly suitable for a rod-shaped cosmetic material having a small core diameter. Here, as a rod-shaped cosmetic material M, a small-diameter rod-shaped cosmetic material having an outer shape of a substantially elliptical shape (cat eye shape; flat shape) is used.

As illustrated in FIGS. 1 to 3, a cosmetic material feeding container 100 has an elongated shape including a writing instrument as a whole, and includes, as an outer shape, a sleeve 1 forming a container front portion, a barrel 2 forming a container intermediate portion, capable of synchronously rotating with the sleeve 1, and incapable of moving in an axial direction, and a tail plug 3 forming a container rear portion, capable of rotating relative to the barrel 2, and incapable of moving in the axial direction.

Figure 4:
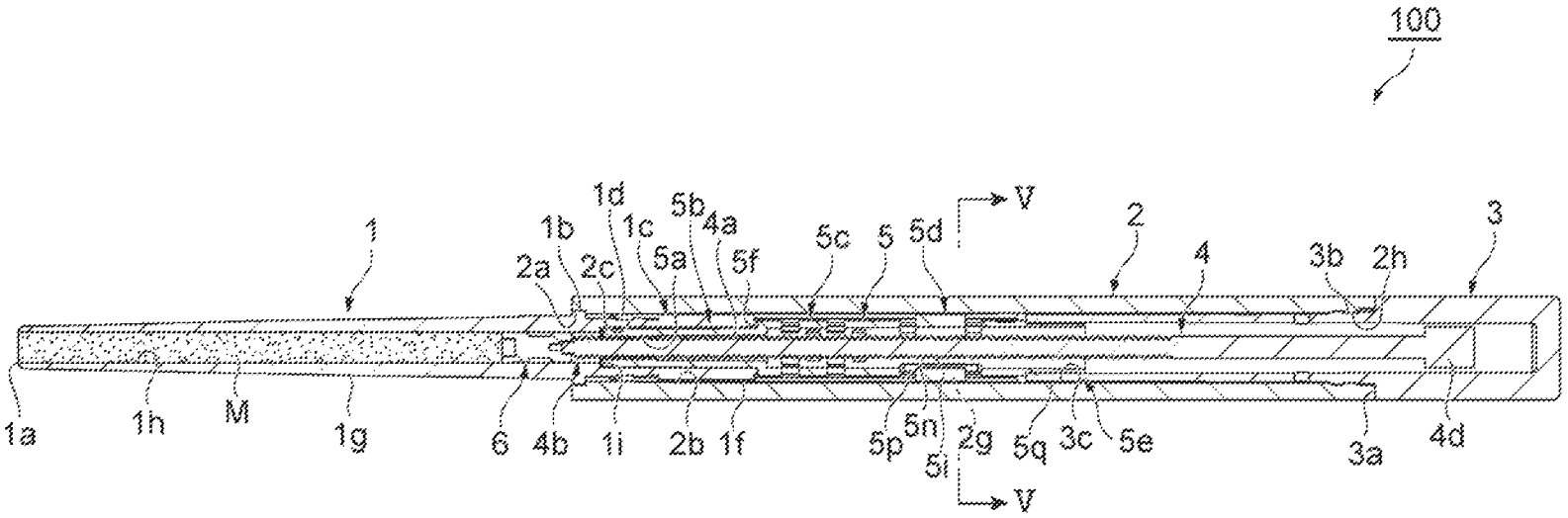
FIG. 4 is a cross-sectional view taken along a line IV-IV in FIG. 3 and illustrating an initial state in which a moving body is located at a retreating limit.

In the cosmetic material feeding container 100, as illustrated in FIG. 4, a rod-shaped cosmetic material M, a moving body (rod) 4 having a male screw 4*a* on an outer periphery thereof, capable of synchronously rotating with the sleeve 1 and moving in the axial direction, and feeding out (pushing out) the rod-shaped cosmetic material M, and a screw 5 having a female screw 5*a* screwed with the male screw 4*a* on an inner periphery thereof, disposed between the sleeve 1 and the tail plug 3, and capable of synchronously rotating with the tail plug 3 are accommodated in the sleeve 1, the barrel 2, and the tail plug 3, the moving body 4 is fed out when the barrel 2 or the sleeve 1 and the tail plug 3 are relatively rotated in the feeding-out direction in which the moving body 4 is fed out, and the rod-shaped cosmetic material M appears from an opening 1*a* at a front end of the sleeve 1 and is used for application.

The sleeve 1 is made of a thermoplastic resin, and as illustrated in FIGS. 8 and 9, is formed in a stepped tubular shape having a step portion (flange portion) 1*b* on an outer peripheral surface at a position close to a rear end portion in the axial direction. The step portion 1*b* has a substantially rectangular outer shape in which opposing arc surfaces are connected by opposing flat surfaces when viewed in the axial direction, a cylindrical portion 1*c* is formed on a rear side of the step portion 1*b*, and the step portion 1*b* and the cylindrical portion 1*c* are used as insertion portions to be inserted into the barrel 2 (see FIG. 4).

A concave portion 1*d* for engaging with the barrel 2 in the axial direction is formed in an annular shape on an outer peripheral surface of the cylindrical portion 1*c* of the sleeve 1 on the rear side of the step portion 1*b*. On an outer peripheral surface of the rear end portion of the sleeve 1 on a rear side of the concave portion 1*d*, ridges 1*f* arranged at 90° intervals along a circumferential direction and extending in the axial direction are provided to be engaged with the barrel 2 in a rotation direction.

As illustrated in FIGS. 1 to 3, a front side of the step portion 1*b* of the sleeve 1 is a flat tubular portion 1*g*, a rear half portion of the flat tubular portion 1*g* has a substantially rectangular cross section (cross section orthogonal to the axial direction) in which the diameter of the step portion 1*b* is reduced, and a front half portion of the flat tubular portion 1*g* has a tapered shape in which both a long side and a short side of the rear half portion gradually become shorter toward the front end.

The sleeve 1 has a substantially elliptical tubular hole from the opening 1*a* at the front end thereof to a rear side portion of the step portion 1*b*, and as illustrated in FIG. 4, the tubular hole is formed as a rod-shaped cosmetic material hole 1*h* through which the rod-shaped cosmetic material M may pass. Further, the tubular hole continuous with the substantially elliptical rod-shaped cosmetic material hole 1*h* is a circular hole having a diameter larger than that of the rod-shaped cosmetic material hole 1*h* from a step portion 1*i*, and is a hole into which a front end portion of the screw 5 is inserted.

The barrel 2 is made of a thermoplastic resin or the like, and is formed in a substantially cylindrical shape elongated in the axial direction as illustrated in FIGS. 10 and 11. The barrel 2 has a concave portion 2*a* formed at a front end portion thereof for accommodating the step portion 1*b* of the sleeve 1. Here, a plurality of ridges 2*b* extending from an inner peripheral surface of the barrel 2 rearward of the concave portion 2*a* to the middle of the barrel 2 in the axial direction is provided at 45° intervals along the circumferential direction. For example, there may be eight ridges 2*b*. The ridge 2*b* is for non-rotatably engaging with the ridge 1*f* of the sleeve 1. Further, a front end portion of the ridge 2*b* has a convex portion 2*c* that further protrudes inward, and the convex portion 2*c* is provided as a portion for engaging with the concave portion 1*d* of the sleeve 1 in the axial direction.

As illustrated in FIG. 5, the ridge 2*b* has a shape having a vertical surface 2*d* vertically extending radially inward, an arc surface 2*e* extending in a substantially arc shape from an apex of the vertical surface 2*d*, and an inclined surface 2*f* inclined at a downward gradient from the arc surface 2*e*. By arranging the plurality of ridges 2*b* having the shape and spacing the plurality of ridges 2*b* apart along the circumferential direction on the inner peripheral surface, as illustrated in FIG. 11, ratchet teeth (first ratchet teeth or first click teeth) 2*g* that are ratchet engaged with the screw 5 are formed at a rear end portion of the rachet teeth 2*g*. Further, a convex portion 2*h* for mounting the tail plug 3 is provided in an annular shape on an inner peripheral surface of a rear end portion of the barrel 2.

The tail plug 3 is made of a thermoplastic resin or the like and, as illustrated in FIGS. 12 and 13, is formed in a stepped bottomed cylindrical shape in which an outer diameter of a rear end portion is made to be a large diameter from a step portion 3*a*. A concave portion 3*b* for engaging with the convex portion 2*h* of the barrel 2 in the axial direction is provided in an annular shape in a small-diameter cylindrical portion on a front side of the large-diameter rear end portion of the tail plug 3. A plurality of concave portions 3*c* extending in the axial direction by a given length and engaging with a rear end portion of the screw 5 in the rotation direction is provided in the inner peripheral surface of the front end portion of the tail plug 3 along the circumferential direction. In the embodiment, a number of the concave portions 3*c* is eight.

Figure 14:
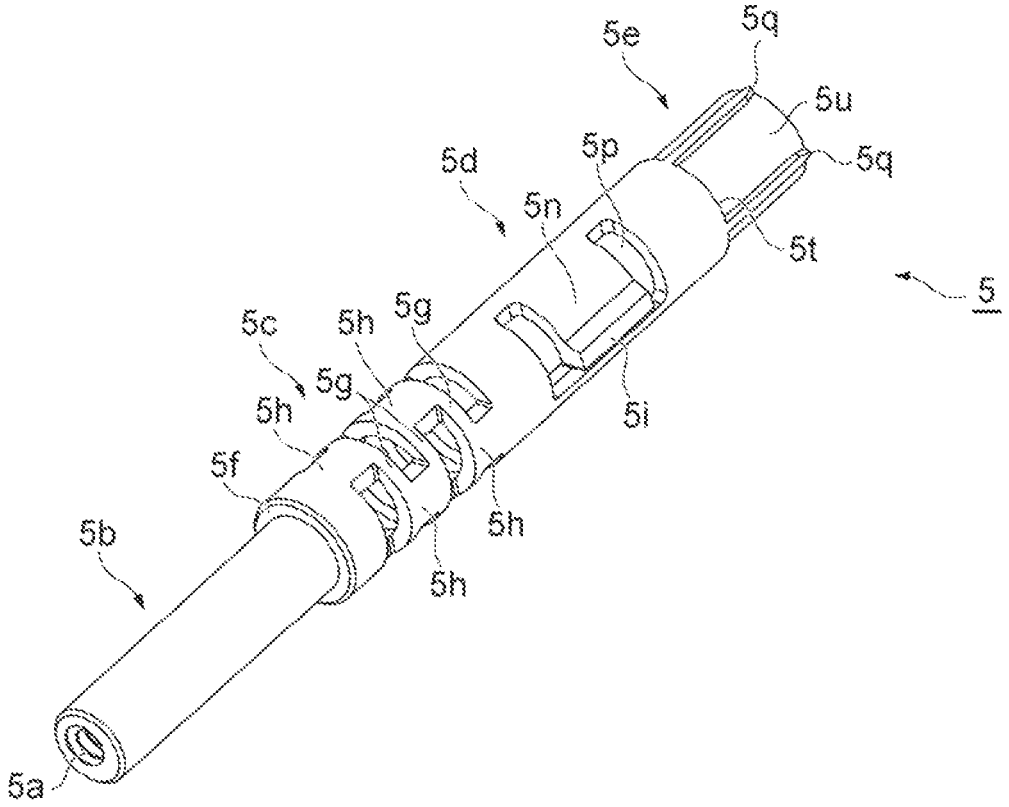
FIG. 14 is a perspective view illustrating the screw in FIGS. 4 to 7.
Figure 15:
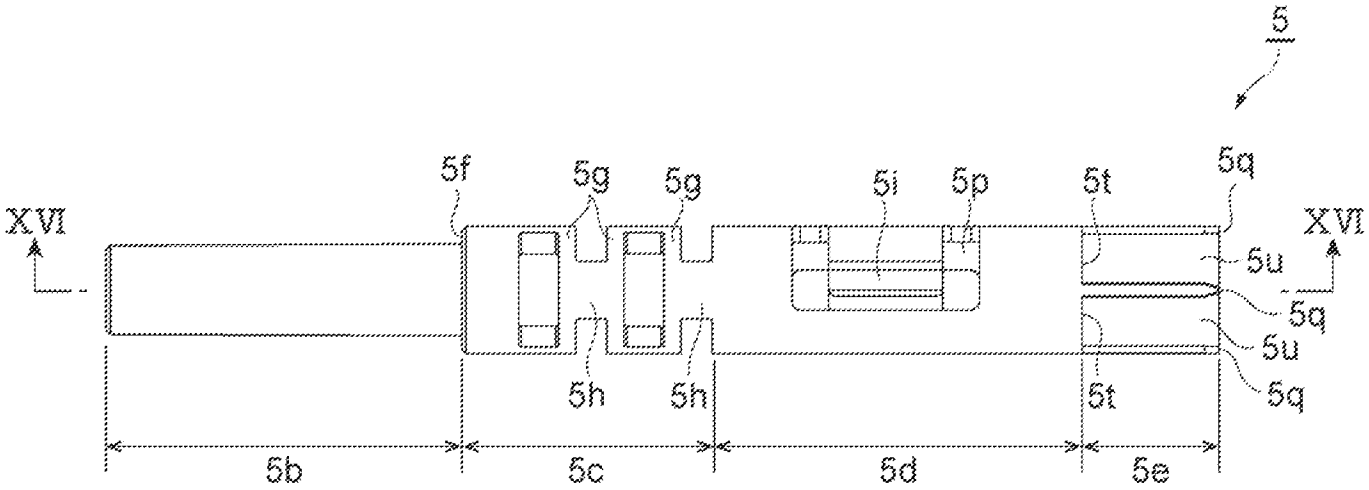
FIG. 15 is a side view of the screw illustrated in FIG. 14.
Figure 16:
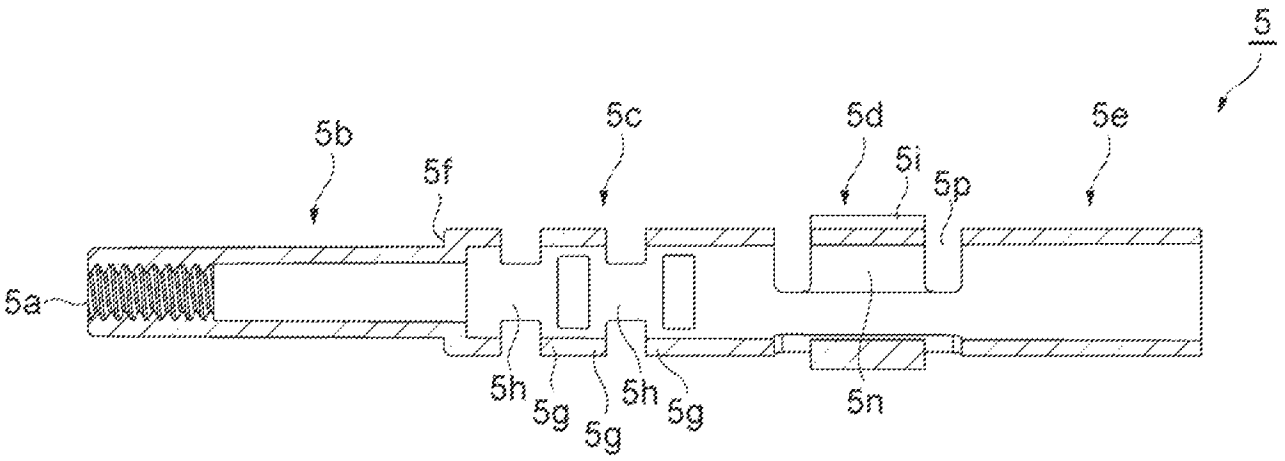
FIG. 16 is a cross-sectional view taken along a line XVI-XVI in FIG. 15.
Figure 17:
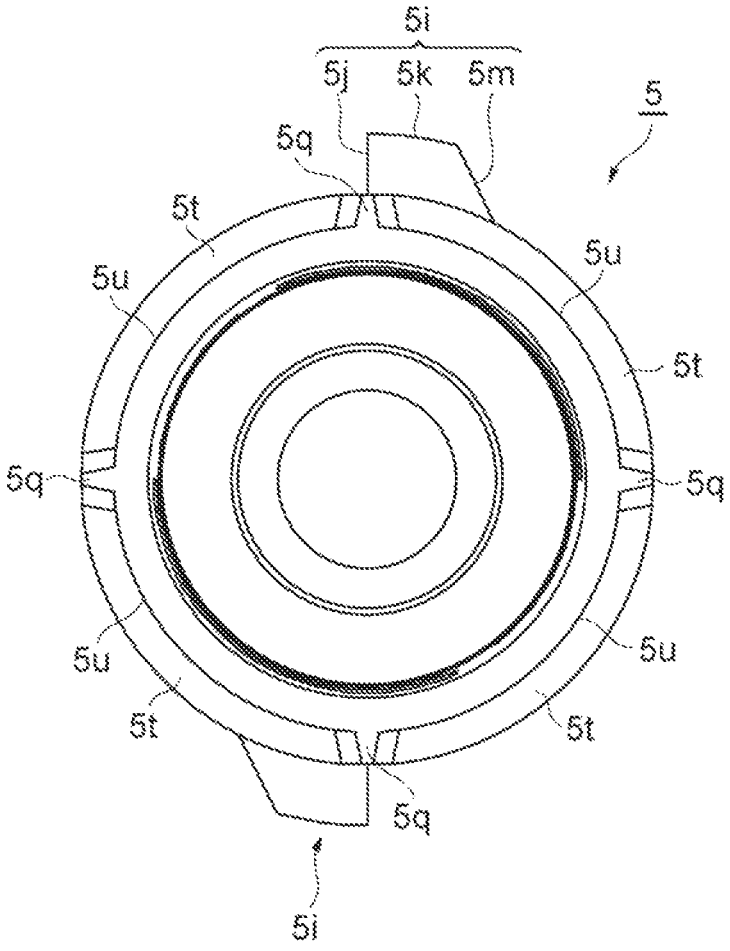
FIG. 17 is a back view of the screw illustrated in FIG. 14.

The screw 5 is made of a thermoplastic resin or the like, is formed in a substantially cylindrical shape elongated in the axial direction as illustrated in FIGS. 14 to 17, and includes a front end portion 5*b*, a first intermediate portion 5*c*, a second intermediate portion 5*d*, and a rear end portion 5*e* in this order from a front end side toward a rear end side as illustrated in FIGS. 14 to 16.

The female screw 5*a* to be screwed with the male screw 4*a* of the moving body 4 is formed on an inner peripheral surface of a front end of the front end portion 5*b*.

The first intermediate portion 5*c* is a so-called resin spring having a diameter larger than that of the front end portion 5*b* from a step portion 5*f* and capable of extending and contracting in the axial direction. The first intermediate portion 5*c* is formed by arranging a plurality of annular portions 5*g* each having a substantially rectangular cross section and a constant thickness so as to be spaced apart from each other in the axial direction, and connecting the annular portions 5*g* by a pair of connecting portions 5*h*, 5*h* extending in the axial direction and facing each other in the radial direction. Here, the pair of connecting portions 5*h*, 5*h* are disposed to be shifted from each other by 90° around the axis with respect to the pair of connecting portions 5*h*, 5*h* adjacent in the axial direction. Since the first intermediate portion 5*c* includes the annular portions 5*g* and the connecting portions 5*h*, 5*h* as described above, the first intermediate portion 5*c* is prevented from being twisted in the rotation direction. That is, the first intermediate portion 5*c* is not (hardly) twisted in the rotation direction. The first intermediate portion 5*c* is for absorbing dimensional errors or the like when assembling components.

A cylindrical portion of the second intermediate portion 5*d* is provided with ratchet teeth (second ratchet teeth or second click teeth) 5*i* that ratchet engage with the ratchet teeth 2*g* of the barrel 2. The ratchet teeth 5*i* are provided at two positions along the circumferential direction. As illustrated in FIG. 17, the ratchet tooth 5*i* extends in the axial direction and has a vertical surface 5*j* vertically extending radially outward, an arc surface 5*k* extending in a substantially arc shape from a vertex of the vertical surface 5*j*, and an inclined surface 5*m* inclined at a downward gradient from the arc surface 5*k* in a cross-sectional shape.

As illustrated in FIG. 14, the ratchet teeth 5*i* are respectively disposed in a pair of openings 5*p* provided along the circumferential direction of the second intermediate portion 5*d* to face each other, and are provided on an outer periphery of front end portions of spring portions 5*n* protruding from circumferential surfaces of openings 5*p* and having flexibility in the radial direction. The shape of the spring portion 5*n* is a cantilever beam shape in this example, but may be a beam shape as long as the spring portion 5*n* has flexibility.

The rear end portion 5*e* is an insertion portion inserted into the tail plug 3, and as illustrated in FIGS. 14 to 17, the rear end portion 5*e* is provided with a plurality of ridges 5*q* each of which has the same diameter as the second intermediate portion 5*d* and extends to the rear end as it is along a circumferential direction so as to be engaged with the concave portions 3*c* of the tail plug 3 in the rotation direction. There may be four ridges Sq. In addition, a concave portion 5*u* is formed between the ridges 5*q* and 5*q* along the circumferential direction of the rear end portion 5*e*, and a concave surface of the concave portion 5*u* is a surface that is inserted into and faces an inner peripheral surface of the front end portion of the tail plug 3 excluding the concave portion 3*c*. A step portion on a front end side forming the concave portion 5*u* serves as an abutting surface 5*t* against which a front end surface of the tail plug 3 abuts. As illustrated in FIG. 16, the rear end portion 5*e*, the first intermediate portion 5*c*, and the second intermediate portion 5*d* have the same inner diameter.

The ratchet teeth 5*i* protrude radially outward than outer peripheral surfaces of the first intermediate portion 5*c* and the rear end portion 5*e* so as to be ratchet engaged with the ratchet teeth 2*g* on the inner peripheral surface of the barrel 2.

The moving body 4 is made of a thermoplastic resin or the like, is elongated in the axial direction, and has a front half formed in a substantially elliptical rod shape as illustrated in FIGS. 18 to 20. The moving body 4 includes the male screw 4*a* extending in the axial direction on a shaft portion 4*b* from the vicinity of the front end portion to the middle in the axial direction so as to be screwed with the female screw 5*a* of the screw 5. As illustrated in FIG. 20, the male screw 4*a* extends in the axial direction so that arc surfaces 4*c* are disposed between two opposite positions on the male screw 4*a* in the circumferential direction by forming portions of the shaft portion 4*b* facing the male screw formed in a round rod when viewed in the axial direction into the arc surface 4*c*. That is, the male screw 4*a* is provided so as to intermittently draw a spiral along the axial direction. The shaft portion 4*b* including the male screw 4*a* and the arc surface 4*c* of the moving body 4, that is, the non-circular shaft portion 4*b* including the male screw 4*a* on the arc surface on the long axis side of the ellipse when viewed in the axial direction, is shaped to be inserted into the substantially elliptical rod-shaped cosmetic material hole 1*h* which is non-circular when viewed in the axial direction of the sleeve 1. Thereby, the shaft portion 4*b* is engaged with the rod-shaped cosmetic material hole 1*h* of the sleeve 1 in the rotation direction to be synchronously rotatable and does not rotate along with the screw 5.

A round rod-shaped shaft portion is continuously provided at a rea side of the shaft portion 4*b* of the moving body 4, and an enlarged diameter portion (protruding portion) 4*d* having a diameter larger than that of the shaft portion is provided at a rear end portion of the shaft portion as a portion for preventing relative rotation of the barrel 2 and the tail plug 3 in the feeding-out direction in which the moving body 4 is fed out. The enlarged diameter portion 4*d* is formed in a cylindrical shape, and an outer diameter thereof is slightly smaller than the inner diameters of the first intermediate portion 5*c*, the second intermediate portion 5*d*, and the rear end portion 5*e* of the screw 5 (see FIG. 16).

As illustrated in FIG. 4, a piston 6 for feeding out (pushing out) the rod-shaped cosmetic material M is installed in the front end portion of the moving body 4. The piston 6 is made of a thermoplastic resin, rubber, silicone, or the like. As illustrated in FIG. 21, the piston 6 has a substantially elliptical cross section slightly smaller than the shape of the rod-shaped cosmetic material hole 1*h* so as to pass through the rod-shaped cosmetic material hole 1*h*.

Then, as illustrated in FIG. 4, in a state where the male screw 4*a* of the moving body 4 is screwed to the female screw 5*a* of the screw 5 and the moving body 4 is screwed to the retreating limit, the screw 5 screwed to the moving body 4 is inserted into the tail plug 3 from the rear end portion 5*e* thereof, the abutting surface 5*t* (see FIG. 14) forming the concave portion 5*u* abuts against the front end surface of the tail plug 3, and the ridge 5*q* is engaged with the concave portion 3*c* of the tail plug 3 in the rotation direction, so that the screw 5 is synchronously rotated with the tail plug 3.

Further, the barrel 2 is attached to the tail plug 3 and the screw 5, the rear end surface thereof is abutted against the step portion 3*a* of the tail plug 3, and the convex portion 2*h* thereof is engaged with the concave portion 3*b* of the tail plug 3 in the axial direction, so that the barrel 2 is mounted to the tail plug 3 so as not to be movable in the axial direction but to be relatively rotatable.

Then, the cylindrical portion 1*c* and the step portion 1*b* of the sleeve 1 are attached to the front end portion 5*b* of the screw 5 and inserted into the front end portion of the barrel 2. The step portion 1*b* of the sleeve 1 is abutted against and accommodated in the concave portion 2*a* of the barrel 2. A front end surface of the screw 5 is abutted against the step portion 1*i* of the sleeve 1. The step portion 5*f* of the screw 5 is abutted against the rear end surface of the sleeve 1. In this state, the concave portion 1*d* of the sleeve 1 is engaged with the convex portion 2*c* of the barrel 2 in the axial direction, and the ridge 1*f* is engaged with the ridge 2*b* of the barrel 2 in the rotation direction, and the sleeve 1 is mounted on the barrel 2 so as to be synchronously rotatable and not to be movable in the axial direction. In this state, the first intermediate portion 5*c* and the second intermediate portion 5*d* of the screw 5 are disposed between the sleeve 1 and the tail plug 3.

In this state, the ratchet teeth 2*g* of the barrel 2 and the ratchet teeth 5*i* of the second intermediate portion 5*d* of the screw 5 are located at substantially the same position in the axial direction and away from each other in the radial direction. As illustrated in FIG. 5, the ratchet teeth 2*g* are ratchet engageable with the ratchet teeth 5*i* in the rotation direction around the axis. That is, the ratchet teeth 2*g*, 5*i* allow only the relative rotation of the barrel 2 and the tail plug 3 in the feeding-out direction in which the moving body 4 is fed out. In FIG. 5, the barrel 2 is rotatable in a counterclockwise direction. The ratchet teeth 2*g*, 5*i* restrict the relative rotation of the barrel 2 and the tail plug 3 in an opposite direction.

As illustrated in FIG. 4, the small-diameter rod-shaped cosmetic material M having the substantially elliptical shape is loaded in front of the piston 6 in the rod-shaped cosmetic material hole 1*h*.

The cosmetic material feeding container 100 configured as described above is put on the market in an initial state in which the moving body 4 is located at the retreating limit, and when the barrel 2 (or the sleeve 1) and the tail plug 3 are relatively rotated in the feeding-out direction in which the moving body 4 is fed out by the user, a screwing action of the male screw 4*a* of the moving body 4 and the female screw 5*a* of the screw 5 works. Since the rod-shaped cosmetic material hole 1*h* of the sleeve 1, the piston 6, and the moving body 4 are prevented from rotating, the moving body 4 is fed out and the rod-shaped cosmetic material M is pressed by the piston 6.

During the relative rotation of the barrel 2 and the tail plug 3, the ratchet teeth 2*g*, 5*i* repeat ratchet engagement/disengagement in the relative rotation direction (see FIG. 5), a click feeling is generated, a degree of the relative rotation and a degree of the forward movement of the moving body 4 are sensed by the user, the rod-shaped cosmetic material M is appropriately pushed out with the click feeling and appears from the opening 1*a* at the front end of the sleeve 1 and can be used for application.

In particular, in the present embodiment, the moving body 4 is fed out, and as illustrated in FIG. 6, the enlarged diameter portion 4*d* of the moving body 4 is located on a radially inner side of the spring portion 5*n* having the ratchet teeth 5*i* of the screw 5 on an outer surface, and as illustrated in FIG. 7, the enlarged diameter portion 4*d* abuts against an inner side of the spring portion 5*n*, and inward bending of the spring portion 5*n* in the radial direction is restricted. Here, as illustrated in FIG. 6, when the front end portion 4*e* of the enlarged diameter portion 4*d* is located inside a rear end portion of the spring portion 5*n*, as illustrated in FIG. 7, the enlarged diameter portion 4*d* comes into contact with the inside of the spring portion 5*n*, and the inward bending of the spring portion 5*n* in the radial direction is restricted.

In this state, the barrel 2 and the tail plug 3 are prevented from further rotating relative to each other in the same direction. The barrel 2 and the tail plug 3 cannot rotate relative to each other in the feeding-out direction in which the moving body 4 is fed out. That is, the moving body 4 reaches the feeding limit. Then, no rotational torque acts on the moving body 4, and the moving body 4 is protected.

Further, according to the present embodiment, since the enlarged diameter portion 4*d* is formed at the rear end portion of the moving body 4, a moving length of the moving body 4 can be increased, and the storage amount of the rod-shaped cosmetic material M can be increased.

Although the present disclosure has been specifically described above based on the embodiment, the present disclosure is not limited to the above embodiment, and for example, in the above embodiment, an application with regard to the cosmetic material feeding container that feeds out the moving body 4 has been described, but the first ratchet teeth 2*g* and the second ratchet teeth 5*i* may be replaced with first and second click teeth each having, for example, a triangular shape (a mountain shape) or the like, and the moving body 4 may be fed out/fed back while the barrel 2 and the tail plug 3 are enabled to rotate relative to each other in both directions and the click engagement/release is repeated to give the click feeling. In this case, for example, a negative pressure may be generated between the front end (here, the piston 6) of the moving body 4 and the rod-shaped cosmetic material M by feeding back the moving body 4, and the rod-shaped cosmetic material M may be fed back. Further, instead of the piston 6 at the front end portion of the moving body 4, for example, by using a cosmetic material holding body capable of holding the rod-shaped cosmetic material M including a core chuck, the rod-shaped cosmetic material M may be fed out/fed back in accordance with the feeding out/feeding back of the moving body 4. Since the enlarged diameter portion 4*d* of the moving body 4 is located on the radially inner side of the spring portion 5*n*, and the barrel 2 and the tail plug 3 cannot rotate further relative to each other in the same direction, no rotational torque acts on the moving body 4, and the moving body 4 is protected. The first ratchet teeth 2*g* may be a first rachet tooth 2*g*. The second rachet teeth 5*i* may be a second rachet tooth 5*i*.

In the above embodiment, the enlarged diameter portion 4*d* is provided at the rear end portion of the moving body 4, but the enlarged diameter portion 4*d* may be provided in the middle of the moving body 4 in the axial direction.

Further, in the above embodiment, two spring portions 5*n* is provided, but one or three or more spring portion may be provided.

Further, in the above embodiment, the application with regard to the rod-shaped cosmetic material M having the substantially elliptical shape has been described, but the cross-sectional shape may be a circular shape, a rectangular shape, a flat shape, or the like. An outer shape of a component including a sleeve, a barrel, and a tail plug in the cross section may be appropriately adopted from various shapes including a circular shape, a rectangular shape, a flat shape, and an elliptical shape.

Further, in the above embodiment, the rod-shaped cosmetic material M has been described, but other cosmetic materials including liquid cosmetic materials and gel-shaped cosmetic materials may be used.

What is claimed is:

1. A cosmetic material feeding container comprising:

a sleeve that is configured to accommodate a cosmetic material and has an opening at a front end of the sleeve through which the cosmetic material is movable;

a barrel that is engaged with the sleeve and synchronously rotatable with the sleeve, and has a first click tooth on an inner periphery of the barrel;

a moving body that is accommodated in the sleeve, synchronously rotatable with the sleeve, has a male screw formed on an outer periphery of the moving body, and is elongated in an axial direction of the moving body;

a screw that is rotatable relative to the barrel, in which a female screw to be screwed with the male screw is formed on an inner periphery of the screw, which is provided with a spring portion having flexibility in a radial direction of the screw, and in which a second click tooth is formed on an outer periphery of the spring portion, the second click tooth repeating click engagement and click release in a rotation direction relative to the first click tooth due to flexibility of the spring portion when the screw is rotated relative to the barrel; and a tail plug that is engaged with the barrel, relatively rotatable with the barrel, and is engaged with the screw and synchronously rotatable with the screw, wherein the relative rotation of the barrel and the tail plug causes a screwing action of the male screw and the female screw, wherein the moving body is fed out by the screwing action and the cosmetic material appears from the opening, wherein the moving body includes an enlarged diameter portion whose diameter is enlarged in a radial direction of the moving body, and wherein the enlarged diameter portion is configured to contact with the spring portion from an inner side of the spring portion when the enlarged diameter portion comes to a position at which inward bending of the spring portion in a radial direction of the spring portion is restricted.

2. The cosmetic material feeding container according to claim 1, wherein the enlarged diameter portion is formed at a rear end portion of the moving body.

3. The cosmetic material feeding container according to claim 2, wherein the first click tooth and the second click tooth are ratchet teeth that restrict relative rotation in a direction in which the moving body is fed back and allow relative rotation in a direction in which the moving body is fed out.

4. The cosmetic material feeding container according to claim 1, wherein the first click tooth and the second click tooth are ratchet teeth that restrict relative rotation in a direction in which the moving body is fed back and allow relative rotation in a direction in which the moving body is fed out.

5. A cosmetic material feeding container comprising:

a sleeve that is configured to accommodate a cosmetic material and has an opening at a front end of the sleeve through which the cosmetic material is movable;

a barrel that is engaged with the sleeve and synchronously rotatable with the sleeve;

a moving body that is accommodated in the sleeve, synchronously rotatable with the sleeve, has a male screw formed on an outer periphery of the moving body, and is elongated in an axial direction of the moving body;

a screw that is rotatable relative to the barrel, in which a female screw to be screwed with the male screw is formed on an inner periphery of the screw, which is provided with a spring portion having flexibility in a radial direction of the screw; and a tail plug that is engaged with the barrel, relatively rotatable with the barrel, and is engaged with the screw and synchronously rotatable with the screw, wherein the relative rotation of the barrel and the tail plug causes a screwing action of the male screw and the female screw, wherein the moving body is fed out by the screwing action and the cosmetic material appears from the opening, wherein the moving body includes an enlarged diameter portion whose diameter is enlarged in a radial direction of the moving body, and wherein the enlarged diameter portion is configured to contact with the spring portion from an inner side of the spring portion when the enlarged diameter portion comes to a position at which inward bending of the spring portion in a radial direction of the spring portion is restricted.

* * * * *